US005503918A

United States Patent [19]

Samson et al.

[11] Patent Number: 5,503,918

[45] Date of Patent: Apr. 2, 1996

[54] METHOD AND MEANS FOR RETAINING PERMETHRIN IN WASHABLE FABRICS

[75] Inventors: Richard D. Samson; James M. McKinney; Geoffrey Gettliffe, all of North Augusta, S.C.

[73] Assignee: Graniteville Company, Grainteville, S.C.

[21] Appl. No.: 401,986

[22] Filed: Mar. 10, 1995

[51] Int. Cl.[6] ..... B32B 33/00

[52] U.S. Cl. ..... 428/248; 135/115; 424/403; 427/412; 428/252; 428/264; 428/265; 428/907

[58] Field of Search ..... 135/115; 424/463; 427/412; 428/248, 252, 264, 265, 907

[56] References Cited

U.S. PATENT DOCUMENTS

| | | | |
|---|---|---|---|
| 5,089,298 | 2/1992 | McNally | 427/240 |
| 5,198,287 | 3/1993 | Samson et al. | 428/248 |
| 5,252,387 | 10/1993 | Samson et al. | 428/248 |

*Primary Examiner*—James C. Cannon
*Attorney, Agent, or Firm*—Clifton Ted Hunt

[57] ABSTRACT

This invention relates to the manufacture of fabric intended to be made into washable end items, and more specifically to the placement of permethrin in the fabric, as an insecticide, and a synergist for retention of the permethrin in the fabric as an effective insecticide through successive washings of the end items.

5 Claims, 1 Drawing Sheet

| ROW | 2 OZ/GAL (11) | 4 OZ/GAL (12) | 6 OZ/GAL (13) | 8 OZ/GAL (14) | 10 OZ/GAL (15) | 0 OZ/GAL (10) |
|---|---|---|---|---|---|---|
| 1 | 1.237 | 1.283 | 1.364 | 1.506 | 1.409 | 1.070 |
| 2 | 1.361 | 1.333 | 1.197 | 1.497 | 1.211 | 0.838 |
| 3 | 0.849 | 0.652 | 0.959 | 1.015 | 0.945 | 0.480 |
| 4 | 68.600 | 50.800 | 70.300 | 67.400 | 67.100 | 44.900 |

FIGURE 1

METHOD AND MEANS FOR RETAINING PERMETHRIN IN WASHABLE FABRICS

FIELD OF THE INVENTION

This invention relates to the finishing of fabric and more specifically to the finishing of fabric in a manner to provide the fabric with effective insecticidal properties through successive washings of end items made from the fabric.

BACKGROUND OF THE INVENTION

Permethrin is a synthetic pyrethroid which exhibits repellent as well as knockdown and kill activity against insects. Pyrethroids, including both the naturally occurring compounds and their synthetically prepared analogs effectively control a variety of pests, such as ticks, cockroaches, houseflies, mosquitoes, and other flying or crawling insects. Pyrethroids are not harmful to plants, food, animals or humans, and leave no harmful residues.

Despite these highly favorable characteristics, permethrin has had only limited general utility because of its relatively short-lived insecticidal activity. This is due to the decomposition of permethrin into a nonactive, non-insecticidal product in the presence of oxygen and ultraviolet light.

Pat. No. 5,198,287 issued Mar. 30, 1993 to Samson, et al. for INSECT REPELLENT TENT FABRIC teaches a tent fabric with a water repellent and flame retardant coating that includes the insecticide permethrin with an effective life of more than six months. Placing the permethrin in the coating for the inner surface of the tent is a major factor in the longevity of the permethrin in tents made in accordance with the '287 patent.

U.S. Pat. No. 5,252,387 issued Oct. 12, 1993 to Samson for FAB-RICS WITH AN INSECT REPELLENT AND A BARRIER teaches that permethrin can be preserved in insect repellent fabrics by placing a barrier over the permethrin to protect the permethrin from degradation by ultraviolet light and oxygen.

Another problem with using permethrin as an insect repellent in washable end items is retaining the permethrin in washable end items through successive wash cycles.

U.S. Pat. No. 5,089,298 issued Feb. 18, 1992 to McNally for SYNERGISTIC EFFECT OF AMYLOPECTIN-PERMETHRIN IN COMBINATION ON TEXTILE FABRICS offers one solution to the problem of retaining permethrin in end items through successive wash cycles. McNally teaches that permethrin is retained in garments impregnated with permethrin and amylopectin, a water soluble form of starch, through a substantially greater number of laundering cycles than garments treated only with permethrin.

Subsequent to the issuance of the foregoing patents, research has continued for effective use of permethrin in repelling mosquitoes and other insects. The importance of the continued research is demonstrated by the more than 50,000 casualties, due to malaria, that the U.S. Army suffered during the Vietnam conflict (Navy Medical Guide, 1984).

Applicants' research, to date, has shown that another synergist, polyvinylacetate, is more effective than amylopectin for the retention of permethrin in fabric through successive wash cycles. The fabric used during applicants' tests is a washable fabric intended for use as various end items, including garments.

McNally impregnates completed garments with amylopectin and permethrin—not the fabric from which the end items is made. Applicants treat the fabric, during its manufacture, with polyvinylacetate and permethrin, which is less expensive and more efficient than treating individual end items with permethrin and a synergist.

SUMMARY OF THE INVENTION

Fabric that is to be made into washable end items is dyed and finished in the normal manner and then treated with polyvinylacetate, after which the fabric is treated with permethrin.

BRIEF DESCRIPTION OF THE DRAWINGS

FIG. 1 shows the amount of permethrin retained after successive washings of fabric that has been treated in accordance with the invention.

DETAILED DESCRIPTION OF THE INVENTION

The fabric or substrate with which this invention is used may be of any desired type suitable for the manufacture of clothing or other washable end items. For example, the fabric may be a plain weave polyester fabric or a 50/50 blend of polyester and cotton, woven as an oxford fabric.

The fabric is treated in the normal manner, and then passed through a pad bath containing a solution of from two (2) ounces to ten (10) ounces of polyvinylacetate per gallon. The fabric then passes through a nip roll and cured in the usual manner.

Following the treatment with polyvinylacetate, the fabric is passed through another pad bath and nip roll. Permethrin is added to the fabric in the last pad bath. Tests were conducted to find the volume of permethrin solution to be used in the last pad bath.

A 0.008% permethrin dispersion, as allowed by Environmental Protective Agency registration, provides an initial concentration in a selected fabric of approximately 1.25 grams of permethrin per square meter, and was used to find the effectiveness of polyvinylacetate as a synergist to prolong the retention of permethrin in washable fabrics.

The exact amount of permethrin to be added depends on the type of fabric being treated. Different fabrics absorb or assimilate different amounts of the permethrin pad bath mixture. The exact amount of permethrin in the last pad bath is determined by successive trials to find the amount necessary to provide an initial concentration in the selected fabric of approximately 1.25 grams of permethrin per square meter. That initial concentration has been found to provide an effective insecticide.

Table I illustrates, in column 10, the initial concentration and the retention, after several wash cycles, of 1.070 grams of permethrin per square meter of fabric without being combined with polyvinylacetate or any other synergist.

Columns 11–15 in the row across the top of Table I show the effect of using different amounts of polyvinylacetate as a synergist, ranging from two ounces per gallon in column 11 to ten ounces per gallon in column 15.

Row 1 shows the initial amount of permethrin in grams per square meter of the fabric that is combined with the different test amounts of polyvinylacetate, as indicated in column 10 and in columns 11–15.

Row 2 shows the number of grams of permethrin remaining in each square meter of the fabric after the fabric has been subjected to one home washing at 140° F., depending on the amount of polyvinylacetate combined with the permethrin, as shown in column 10 and in columns 11–15.

Row 3 shows the number of grams of permethrin remaining in each square meter of the fabric after the fabric has been subjected to five home washing at 140° F., depending on the amount of polyvinylacetate combined with the permethrin, as shown in column 10 and in columns 11–15.

Row 4 shows the percentage of the initial concentration of permethrin that remains in the fabric after five home washings at 140° F.

Row 5 shows the number of grams of permethrin remaining in each square meter of the fabric after the fabric has been subjected to ten home washing at 140° F., depending on the amount of polyvinylacetate combined with the permethrin, as shown in column 10 and in columns 11–15.

Row 6 shows the number of grams of permethrin remaining in each square meter of the fabric after the fabric has been subjected to twenty home washing at 140° F., depending on the amount of polyvinylacetate combined with the permethrin, as shown in column 10 and in columns 11–15.

However, further testing is being done to find other synergists and other ways of applying the synergist. For example, applying permethrin via thickened aqueous dispersion as a coating on the outer surface of fabric ensures placement of permethrin on the outer surface of apparel fabric. This minimizes skin contact and maximizes insect contact to permethrin.

Although specific terms have been used in describing the invention, they have been used in a descriptive sense only, and not for the purpose of limitation.

TABLE 1

| ROW | Column 10 | Column 11 | Column 12 | Column 13 | Column 14 | Column 15 |
|---|---|---|---|---|---|---|
| 1 | 1.070 | 1.237 | 1.283 | 1.364 | 1.506 | 1.409 |
| 2 | .830 | 1.361 | 1.333 | 1.197 | 1.497 | 1.211 |
| 3 | .480 | .849 | .652 | .959 | 1.015 | .945 |
| 4 | 44.900 | 68.600 | 50.800 | 70.300 | 67.400 | 67.100 |
| 5 | .282 | .334 | .431 | .569 | .560 | .505 |
| 6 | 0 | .088 | .027 | .148 | .201 | .265 |

The data in Table I is shown graphically in FIG. 1.

The permethrin content in the fabric, before and after washing the fabric, was determined by gas chromatographic analysis (GCA), the same test described in the prior art McNally patent. McNally's use of amylopectin (starch) does increase the retention of permethrin, even after fifty wash cycles at 120° F., but not by much. Applicants have not done as extensive testing as McNally, but comparing McNally's retention of permethrin after five wash cycles at 120° F. with applicant's retention of permethrin after five wash cycles at 140° F. shows that polyvinylacetate is a more effective synergyst than amylopectin for the retention of permethrin in washable fabrics.

As indicated by the chart in FIG. 1, when permethrin is applied to the fabric without polyvinylacetate, only 44.9% of the permethrin remains in the fabric after five home washings at 140° F. With the use of different amounts of polyvinylacetate as a synergist, the retention of permethrin in the fabric averages 65% after five home washings at 140° F. Using 6 ounces of polyvinylacetate per gallon as the synergist retains over 70% of the permethrin after five wash cycles.

It is apparent that polyvinylacetate is a more effective synergist than amylopectin for the retention of permethrin in fabric through successive washings.

We claim:

1. A fabric intended to be used in the manufacture of washable end items, the fabric containing permethrin and polyvinylacetate that retains permethrin as an effective insecticide in the fabric after the fabric has been made into end items and passed through successive wash cycles.

2. A fabric according to claim 1 wherein a dispersion of permethrin is applied to the fabric in an initial concentration not to exceed 1.25 grams per square meter of fabric.

3. A fabric according to claim 1 wherein a dispersion of permethrin is applied to the fabric in an initial concentration not to exceed 1.25 grams per square meter of fabric.

4. A method of adding permethrin to fabric that is to be made into washable end items, said method comprising the steps of:

(a) passing the fabric through a bath containing polyvinylacetate; and (b) passing the fabric through a bath containing permethrin.

5. A method of adding permethrin to fabric that is to be made into washable end items, said method comprising the step of passing the fabric through a bath containing permethrin and polyvinylacetate.

* * * * *